US006687945B2

(12) United States Patent
Robinson

(10) Patent No.: US 6,687,945 B2
(45) Date of Patent: Feb. 10, 2004

(54) METHOD AND APPARATUS FOR ROTATING A PAINT GUARD

(75) Inventor: Glenn Robinson, Monmouth Junction, NJ (US)

(73) Assignee: Ideavillage Products Corp., Fairfield, NJ (US)

( * ) Notice: Subject to any disclaimer, the term of this patent is extended or adjusted under 35 U.S.C. 154(b) by 196 days.

(21) Appl. No.: 09/878,669

(22) Filed: Jun. 11, 2001

(65) Prior Publication Data

US 2002/0187273 A1 Dec. 12, 2002

(51) Int. Cl.[7] ..... B05C 17/02; B05C 21/00
(52) U.S. Cl. ..... 15/230.11; 15/248.2
(58) Field of Search ..... 15/230.11, 248.2, 15/246

(56) References Cited

U.S. PATENT DOCUMENTS

| | | | | |
|---|---|---|---|---|
| 2,763,022 | A | | 9/1956 | Glacken |
| D193,382 | S | | 8/1962 | Goetz |
| 3,052,910 | A | | 9/1962 | Kushner |
| 3,213,477 | A | | 10/1965 | Shafer |
| 3,369,269 | A | | 2/1968 | Deck et al. |
| 3,623,180 | A | | 11/1971 | Anderson |
| 3,685,084 | A | | 8/1972 | Bennett |
| 3,832,749 | A | | 9/1974 | Hawk |
| 4,100,642 | A | | 7/1978 | Gabor |
| 4,528,712 | A | * | 7/1985 | Leibow |
| 4,564,970 | A | | 1/1986 | Latraverse |
| 5,207,755 | A | | 5/1993 | Ampian |
| 5,444,891 | A | | 8/1995 | Benson |
| 5,623,740 | A | | 4/1997 | Burns et al. |
| D392,102 | S | | 3/1998 | Snetting et al. |
| 2001/0049852 | A1 | * | 12/2001 | Burns et al. |

* cited by examiner

*Primary Examiner*—Randall E. Chin
(74) *Attorney, Agent, or Firm*—Bazerman & Drangel PC

(57) ABSTRACT

A paint roller apparatus for applying paint to a painted surface includes a rotating accessory arm. The rotating accessory arm is rotatably mounted on a handle of the paint roller apparatus such that the accessory arm rotates between a first position wherein an accessory or the accessory arm is substantially proximate to a cylindrical roller of the paint roller apparatus and a second position where the accessory arm is at an angle of substantially ninety degrees to a plane defined by the longitudinal axes of the handle and the roller. A switch assembly located on the handle provides for rotation of the accessory arm with minimal effort on the part of the user. The switch assembly may include a locking mechanism to lock the accessory arm into the first position and second position so that the accessory arm does not rotate inadvertently.

9 Claims, 5 Drawing Sheets

METHOD AND APPARATUS FOR ROTATING A PAINT GUARD

FIELD OF THE INVENTION

The present application relates to a paint roller apparatus with an accessory arm rotatably mounted on a handle of the paint roller so that the accessory on the accessory arm rotates between a first position substantially proximate to the roller of the paint roller apparatus and a second position substantially remote from the roller. Rotation of the accessory arm is facilitated by a switch located on the handle of the paint roller.

BACKGROUND

Conventional paint rollers allow for swift application of paint over large open areas on flat surfaces and for ease in loading paint onto the roller after paint is applied to the wall. However, where two surfaces are adjacent one another, and one of the surfaces is to be painted while the adjacent surface is to remain paint free or is to be painted a different color, it is difficult to apply paint to the junction of the two surfaces and to prevent paint from being applied to the adjacent surface.

Paint rollers are traditionally loaded with paint in a paint tray. Paint is poured into the tray and the roller of the paint roller is rolled in the paint. While this is a relatively quick method of loading the roller with paint, it typically results in paint being applied to the end of the roller. Accordingly, when one attempts to paint a surface, the paint on the end of the roller may be applied to the adjacent surface as the area near the junction of the surfaces is painted.

Several solutions have been proposed in order to alleviate this problem. For example, U.S. Pat. No. 3,369,269 to Deck ("Deck Patent") relates to a paint roller including a handle, one end of which includes a hand grip and the other end of which is bent perpendicular to the longitudinal axes of the hand grip so as to form a shaft around which a roller can rotate. A cover plate is provided in a plane perpendicular to the longitudinal axis of the roller and spaced a slight distance from the end of the roller. The cover plate is mounted on an arm supported on the handle such that the arm and cover plate can swing around the longitudinal axis of the handle and be held in a position remote from the roller. Thus, the cover plate can be positioned adjacent the roller to protect an adjacent surface and can be rotated away from the roller to allow the roller to be loaded with paint.

U.S. Pat. No. 5,623,740 to Burns et al. ("Burns Patent") includes a handle and an edge guard with four edges and a front and back face. The edge guard is pivotally and rotatably supported on a fixed arm connected to the handle. The roller sock is rotatably supported on the handle such that the roller sock may be rotated from a painting position, wherein the roller sock longitudinal axis is perpendicular to and adjacent the edge guard front face and a filling position wherein the roller sock longitudinal axis is parallel to the edge guard front face.

While the paint rollers of the Deck and Burns Patents prevent application of paint to an adjacent surface, each has limitations. For example, a user of the paint roller of the Deck Patent most likely uses two hands to slide the cover plate arm down the shaft of the handle to swing the cover plate around the longitudinal axis of the handle. Also, the Burns Patent, by rotating the roller sock instead of the edge guard, likely requires greater force to be moved since the roller is heavier than the edge guard.

Thus, it would be beneficial to provide a paint roller apparatus with a paint guard that protects a surface adjacent a painted surface while a user paints but also allows quick and efficient separation of the paint guard and roller so that paint can be loaded on the roller while the paint guard remains paint free.

SUMMARY OF THE INVENTION

An object of the invention is to provide a paint roller apparatus with accessory that allows for separation of the roller and accessory while paint is applied to the roller that avoids the problems described above.

It is a further object to provide a paint roller apparatus with accessory which allows for separation of the roller and accessory while paint is applied to the roller in which the separation is achieved by manipulation of a switch located on the handle.

An additional object of the invention is to provide a paint roller apparatus for applying paint to a surface, including a handle, a roller support extending from the handle, a cylindrical roller rotatably attached to the roller support for applying paint to a surface being painted and an accessory mounted on an end of an accessory arm. The accessory arm is rotatably connected to the handle to rotate from a first position to a second position. A switch assembly for rotating the accessory arm from the first position to the second position is provided, where one end of the accessory arm includes a spiral groove about a longitudinal axis of the accessory arm and a protrusion from a switch of the switch assembly engages the groove such that as the switch is moved, the protrusion moves through the spiral groove to cause the accessory arm to rotate.

The switch assembly may further include a locking button which is biased in an upward position to lock the switch into place when the accessory arm is in one of the first position and the second position. The locking button may include at least one post protruding from at least one side of the locking button such that when the button is in the upward position, the post comes into contact with a block extending down from an interior surface of the handle and prevents movement of the switch, and when the locking button is depressed, the post is lowered under the block such that the switch is moveable.

The accessory may be a paint guard including a first portion having a first and second side, the first portion pivotally attached to the end of the accessory arm, and a second portion pivotally connected to the first portion such that the second portion includes at least one straight edge which extends beyond an outer periphery of the first portion.

Another object of the invention is to provide a method for applying paint to a surface including the steps of rotating an accessory arm, including an accessory mounted on a first end thereof, rotatably mounted on a handle of a paint roller apparatus at a second end thereof, from a first position to a second position. The rotation results from moving a switch positioned on the handle in a direction parallel to a longitudinal axis of the handle of the paint roller apparatus. A cylindrical paint roller is lowered into a paint tray to apply paint to the cylindrical roller while the accessory remains paint free. The cylindrical roller is then removed from the paint tray. The switch is moved to return the accessory arm back to the first position. Paint is then applied to the surface being painted with the cylindrical roller.

The method of applying paint may further include steps of depressing a locking button which is biased in an upward position to lock the switch into place when the accessory arm is in one of the first position and the second position such that the switch can be moved. The accessory of the paint roller apparatus used in the method of applying paint may be a paint guard including a first portion having a first and second side, the first portion pivotally connected to the first end of the accessory arm, and a second portion pivotally connected to the first portion such that the second portion includes at least one straight edge which extends beyond an outer periphery of the first portion and prevents paint from being applied to a surface adjacent to a surface being painted during the step of applying paint to the surface being painted.

Also, an object of the invention is to provide a paint roller apparatus for applying paint to a surface including a handle, a roller support extending from the handle, a cylindrical roller rotatably attached to the roller support for applying paint to the surface, an accessory mounted on an end of an accessory arm. The accessory arm is rotatably connected to the handle to rotate from a first position to a second position. A switch assembly is positioned on the handle for rotating the accessory arm from the first position to the second position when a switch of the switch assembly is moved in a direction parallel to the longitudinal axis of the handle of the paint roller apparatus.

The switch assembly may further include a locking button which is biased in an upward position to lock the switch into place when the accessory arm is in one of the first position and the second position such that the switch cannot be moved.

The locking button may further include at least one post protruding from at least one side of the locking button such that when the locking button is in the upward position, the post comes into contact with a block extending down from an interior surface of the handle and prevents movement of the switch, and when the locking button is depressed, the post is lowered under the block such that the switch is moveable in the direction parallel to the longitudinal axis of the handle.

The locking button may include a non-slip surface on a top thereof so that a user finger will not slip off the locking button while moving the switch.

The accessory of the paint roller apparatus may be a paint guard including a first portion having a first and second side, the first portion pivotally attached to the end of the accessory arm, and a second portion pivotally connected to the first portion such that the second portion includes at least one straight edge which extends beyond an outer periphery of the first portion and prevents paint from being applied to a surface adjacent to the painted surface.

DETAILED DESCRIPTION

Figure 1:
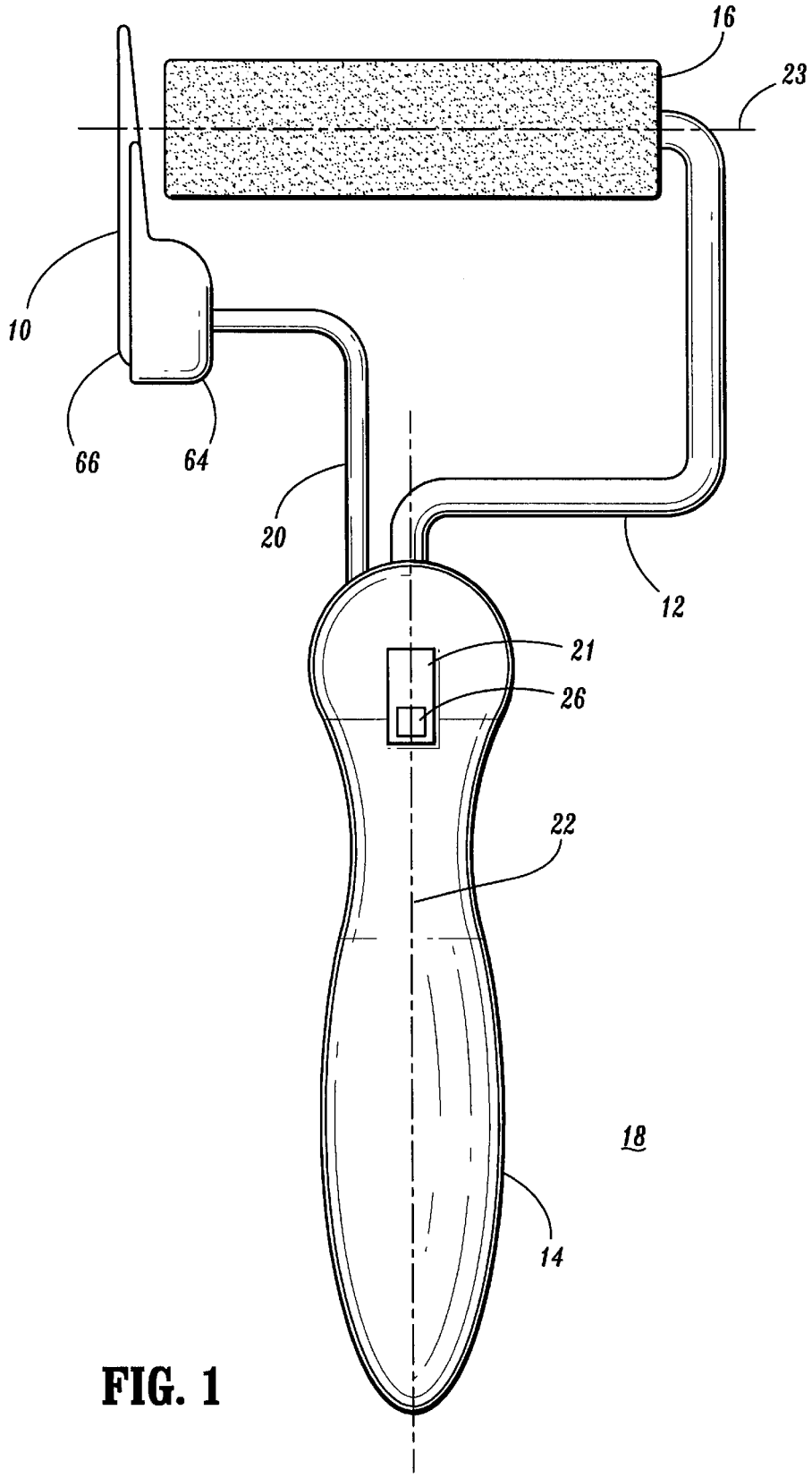
FIG. 1 shows a paint roller with accessory according to an embodiment of the present invention.
Figure 6:
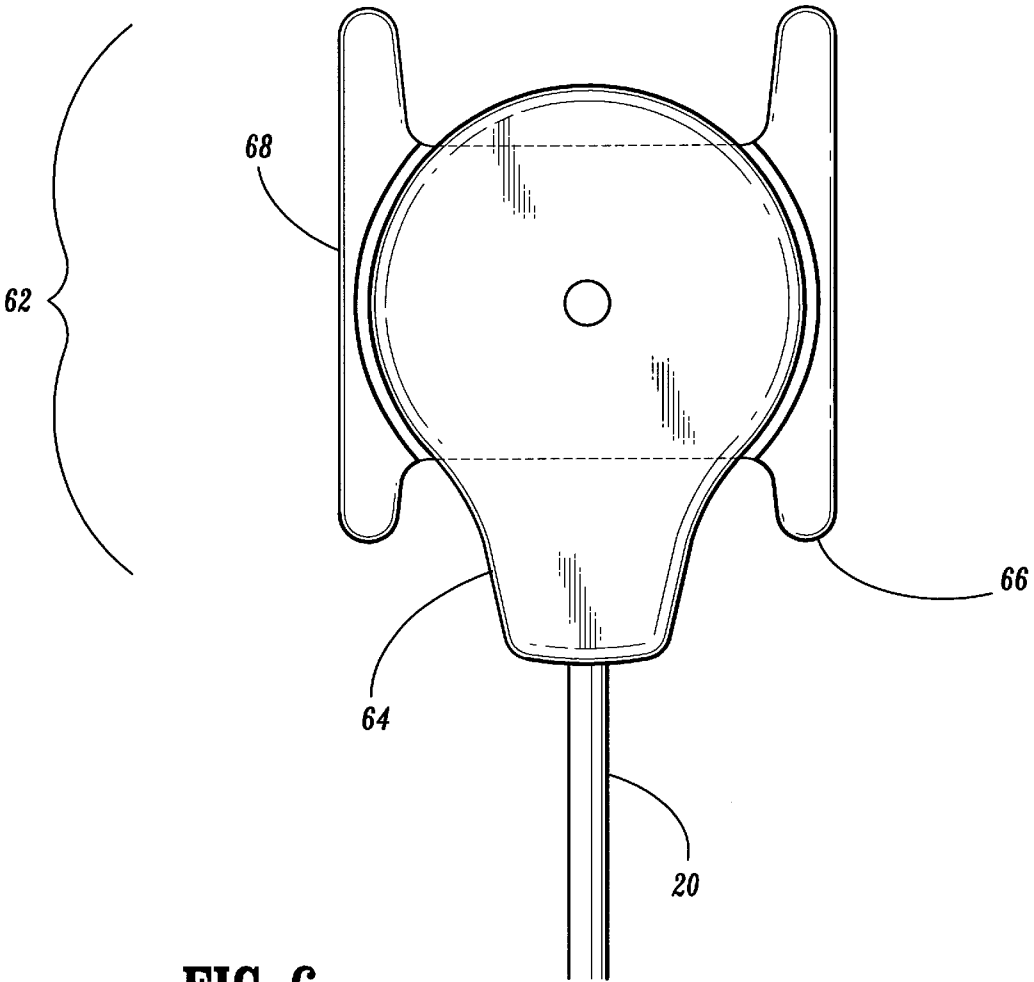
FIG. 6 illustrates a two piece paint guard accessory according to an embodiment of the present invention.

A paint roller apparatus 18 with a rotatable accessory arm 20 is described with reference to FIG. 1. In FIG. 1, the accessory 10 is depicted as a paint guard (such as shown in FIG. 6) for preventing application of paint to a surface adjacent a surface being painted. A roller support 12 is fixedly attached to a handle 14. A cylindrical roller 16 is rotatably attached to the roller support 12 and extends in a direction perpendicular to a longitudinal axis 22 of the handle 14. An accessory arm 20 is rotatably attached to the handle 14. The accessory arm 20 is rotatable from a first position, wherein the accessory 10 is located substantially proximate to the cylindrical roller 16 and the accessory arm 20 is substantially in a plane defined by the longitudinal axis 22 of the handle 14 and longitudinal axis 23 of the cylindrical roller 16 ("handle/roller plane"), to a second position wherein the accessory 10 is substantially remote from the cylindrical roller 16 and the accessory arm 20 is in a position substantially perpendicular to the handle/roller plane, in other words, out of the page of FIG. 1.

Figure 2:
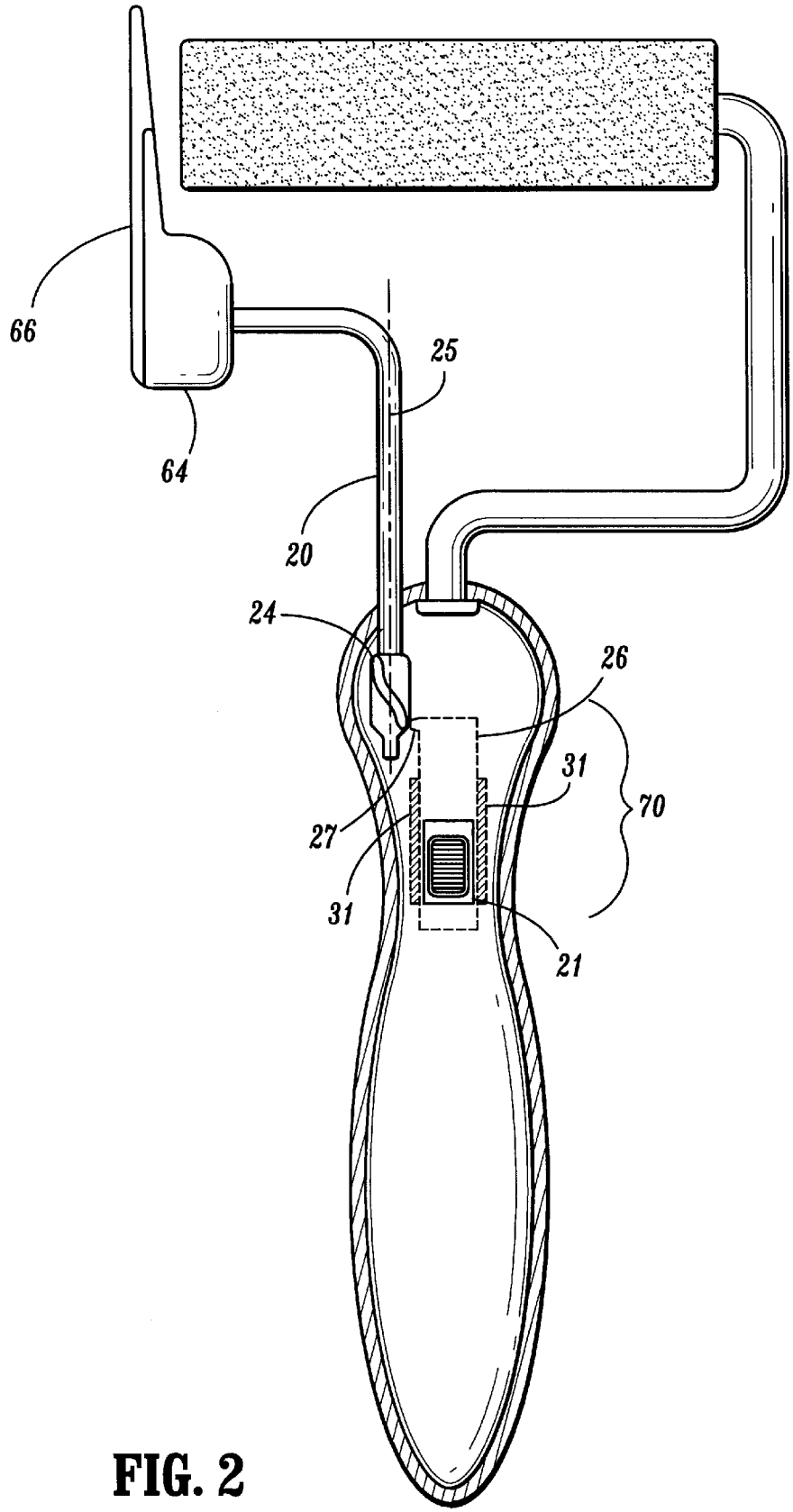
FIG. 2 illustrates a switch assembly according to an embodiment of the present invention for rotating an accessory arm on which an accessory of a paint roller apparatus is mounted.

One means for rotating the accessory arm 20 is illustrated with reference to FIG. 2. One end of the accessory arm 20 includes a spiral groove 24 about a longitudinal axis 25 of the accessory arm 20. A switch assembly 70 is positioned in the handle 14 and protrudes through hole 21 in the surface of handle 14. A switch 26 of the switch assembly 70 moves forward and backward along or parallel to the longitudinal axis 22 of handle 14 between guides 31. A protrusion 27 extends from the switch 26 into the spiral groove 24 on the accessory arm 20 such that when the switch 26 is moved, the protrusion 27 travels in the spiral groove 24 causing the accessory arm 20 to rotate between the first and second position. Use of this switch assembly 70 allows for quick and efficient rotation of the accessory arm 20 with minimal effort on the part of the user. The switch 26 is moveable through application of force by a single finger. In addition, the switch assembly maintains a relatively low profile with respect to the surface of the handle 14 so that it does not interfere with painting when not in use.

Figure 4:
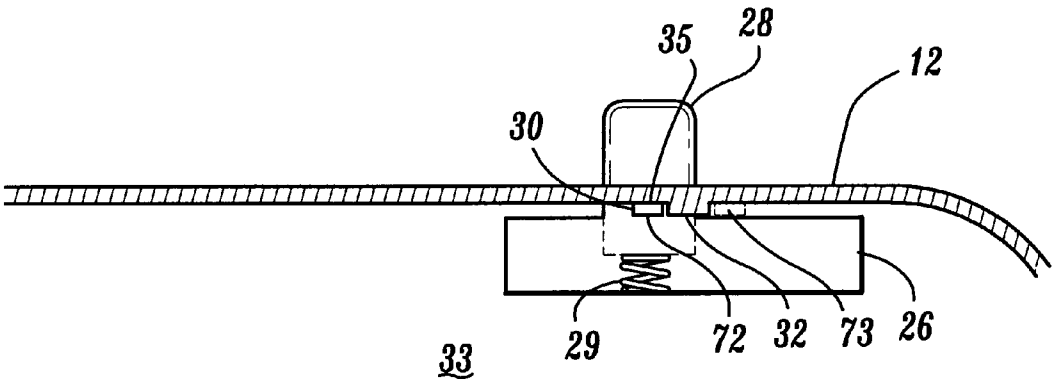
FIG. 4 illustrates an embodiment of the present invention in which a switch of a switch assembly used to rotate an accessory arm includes a locking mechanism.
Figure 3:
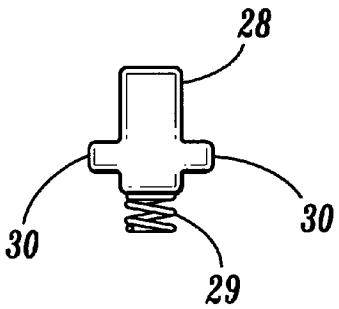
FIG. 3 illustrates a locking button included in a locking mechanism according to an embodiment of the present invention.

A second embodiment of the switch assembly 70 incorporates a locking mechanism 33 as illustrated in FIG. 3 and FIG. 4. In this embodiment, the switch assembly 70 includes a locking button 28 biased in an upright position using a biasing means such as a spring 29 to lock the switch 26 in place when the accessory arm 20 is in either the first position or second position. Locking of the accessory arm 20 into either the first position or second position ensures that accessory arm 20 does not inadvertently rotate during painting or loading of the roller with paint. As seen in FIG. 3, at least one post 30 extends outward from the side of locking button 28. The spring 29 keeps post 30 in contact with an interior surface 35 of the handle 14. The switch 26 is prevented from moving due to the interference between the post 30 and a block 32 formed on the interior surface 35 of the handle 14. When the locking button 28 is depressed, the post 30 is lowered below the block 32 and the switch 26 is moveable forward from lock position 72 to lock position 73, which corresponds to the second position of accessory arm 20, or backward from lock position 73 to lock position 72, which corresponds to the first position of the accessory arm 20, along or parallel to the longitudinal axis of the handle.

The locking button 28 can be formed with or include a non-slip top surface such as indentations in the top surface, or a non-slip covering to prevent a user's finger from slipping off the locking button 28 when accessory arm 20 is being moved.

Figure 5:
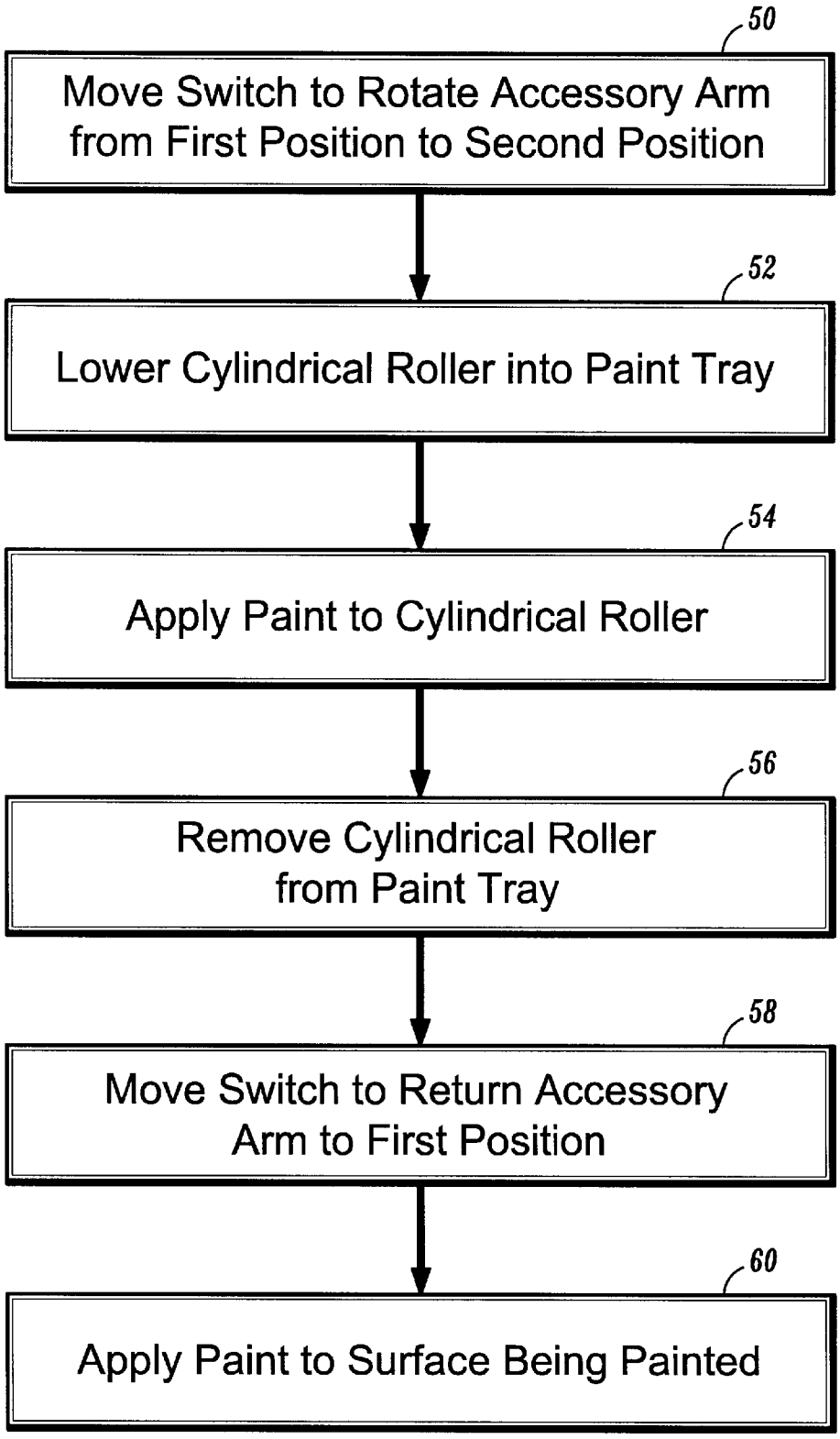
FIG. 5 illustrates a method of applying paint to a wall according to an embodiment of the present invention.

A method for applying paint to a wall is described with relation to FIG. 5. In step 50, an accessory arm 20, including an accessory 10 mounted on one end thereof, which is rotatably mounted on a handle 14 of a paint roller apparatus at a second end thereof is rotated from a first position in which the accessory 10 is substantially proximate to a cylindrical roller 16 of the paint roller apparatus to a second position in which the accessory is substantially remote from the cylindrical roller 16 and the accessory arm 20 is at an angle of substantially ninety degrees to the handle/roller plane. This rotation is achieved by switch assembly 70 positioned on the handle 14 with switch 26 movable parallel to or along the longitudinal axis 22 of the handle 14 by a finger of a user. In step 52, the cylindrical roller 16 is lowered into a paint tray (not shown). In step 54, paint is applied to the cylindrical roller 16 from the paint tray. In step 56, the cylindrical roller 16 is removed from the paint tray. In step 58, the switch 26 is moved in an opposite direction to return the accessory 10 to the position substantially proximate to the cylindrical roller 16. In step 60, paint is applied to the surface being painted using the cylindrical roller 16. While the paint is applied to the surface, the accessory 10 remains substantially proximate to the end of the cylindrical roller 16 preventing paint from being applied to the adjacent surface which is not being painted.

In another embodiment, the paint roller apparatus used in the method of applying paint to a surface being painted illustrated in FIG. 5 includes a locking mechanism 33 such as described above. The method of painting a wall with such a paint roller apparatus is substantially the same as that described in FIG. 5, with the added step of depressing the locking button, prior to moving the switch 26 in steps 50 and 58 to rotate the accessory 10 from the first position to the second position and then back to the first position, respectively.

The accessory 10 mounted on the accessory arm 20 is preferably a paint guard 62, attached to the accessory arm 20 such that an inner face of the paint guard is perpendicular to the longitudinal axis 23 of the cylindrical roller 16. More specifically, the paint guard 62 includes two portions, an inner portion 64 and outer portion 66 as shown in FIG. 6. The inner portion 64 is pivotally attached to the accessory arm 20. The outer portion 66 is pivotally attached to the inner portion 64. The outer portion 66 includes at least one straight edge 68. The straight edge 68 extends beyond an outer periphery of the inner portion 64 and slides along the surface being painted as paint is applied to the surface being painted to prevent paint from being applied to a surface adjacent the surface being painted.

While the present application describes specific embodiments of a paint roller apparatus and method of applying paint to a wall, it should be understood that many variations are possible. This application is intended to cover the full scope of variations permissible under the claims included herewith.

What is claimed is:

1. A paint roller apparatus for applying paint to a surface, said paint roller apparatus comprising:

a handle;

a roller support extending from the handle;

a cylindrical roller rotatably attached to the roller support for applying paint to a surface being painted;

an accessory mounted on an end of an accessory arm, wherein the accessory arm is rotatably connected to the handle to rotate from a first position to a second position and the accessory arm includes a spiral groove; and a switch assembly for rotating the accessory arm from the first position to the second position where a protrusion from a switch of the switch assembly engages the spiral groove such that as the switch is moved, the protrusion moves through the spiral groove to cause the accessory arm to rotate.

2. The paint roller apparatus of claim 1, wherein the switch assembly further comprises a locking button which is biased in an upward position to lock the switch into place when the accessory arm is in one of the first position and the second position.

3. The paint roller apparatus of claim 2, wherein the locking button further comprises at least one post protruding from at least one side of the locking button such that when the locking button is in the upward position, the post comes into contact with a block extending down from an interior surface of the handle and prevents movement of the switch, and when the locking button is depressed, the post is lowered under the block such that the switch is moveable.

4. The paint roller apparatus of claim 1 wherein the accessory comprises:

a paint guard including a first portion having a first and second side, the first portion pivotally attached to the end of the accessory arm, and a second portion pivotally connected to the first portion such that the second portion includes at least one straight edge which extends beyond an outer periphery of the first portion.

5. A paint roller apparatus for applying paint to a surface comprising:

a handle;

a roller support extending from the handle;

a cylindrical roller rotatably attached to the roller support for applying paint to the surface;

an accessory mounted on an end of an accessory arm, wherein the accessory arm is rotatably connected to the handle to rotate from a first position to a second position; and a switch assembly positioned on the handle, for rotating said accessory arm from the first position to the second position, when the switch is moved in a direction parallel to the longitudinal axis of the handle of the paint roller apparatus;

said movement of the switch assembly rotating the accessory arm in and out of said first and second positions.

6. The paint roller apparatus according to claim 5 wherein the accessory comprises:

a paint guard including a first portion having a first and second side, the first portion pivotally attached to the end of the accessory arm, and a second portion pivotally connected to the first portion such that the second portion includes at least one straight edge which extends beyond an outer periphery of the first portion and prevents paint from being applied to a surface adjacent to the painted surface.

7. A paint roller apparatus for applying paint to a surface comprising:

a handle;

a roller support extending from the handle;

a cylindrical roller attachably attached to the roller support for applying paint to the surface;

an accessory mounted on an end of an accessory arm, wherein the accessory arm is rotatably connected to the handle to rotate from a first position to a second position;

a switch assembly positioned on the handle, for rotating said accessory arm from the first position to the second position, when the switch is moved in a direction parallel to the longitudinal axis of the handle of the paint roller apparatus;

said switch assembly having a locking button which is biased in an upward position to lock the switch into place when the accessory arm is in one of the first position and the second position such that the switch cannot be moved.

8. The paint roller apparatus of claim 7, wherein the locking button further comprises:

at least one post protruding from at least one side of the locking button such that when the locking button is in the upward position, the past comes into contact with a block extending down from an interior surface of the handle and prevents movement of the switch, and when the locking button is depressed, the post is lowered under the block such that the switch is moveable in the direction parallel to the longitudinal axis of the handle.

9. The paint roller apparatus according to claim 7 wherein the locking button comprises a non-slip surface on a top thereof so that a user finger will not slip off the locking button while moving the switch.

* * * * *